US008800785B2

(12) United States Patent
Kalafut

(10) Patent No.: US 8,800,785 B2
(45) Date of Patent: Aug. 12, 2014

(54) MERCHANDISING DISPLAY DEVICE

(71) Applicant: Midland Metal Products, Chicago, IL (US)

(72) Inventor: Andrew Kalafut, Justice, IL (US)

(73) Assignee: Midland Metal Products, Chicago, IL (US)

( * ) Notice: Subject to any disclaimer, the term of this patent is extended or adjusted under 35 U.S.C. 154(b) by 0 days.

(21) Appl. No.: 13/629,104

(22) Filed: Sep. 27, 2012

(65) Prior Publication Data

US 2014/0083959 A1 Mar. 27, 2014

(51) Int. Cl.

| | |
|---|---|
| ***E05B 73/00*** | (2006.01) |
| *A47F 5/08* | (2006.01) |
| *A47H 1/00* | (2006.01) |
| *A47G 29/087* | (2006.01) |
| *A47B 43/00* | (2006.01) |
| *A47B 47/00* | (2006.01) |

(52) U.S. Cl.
USPC ..... 211/7; 211/193; 211/59.1; 211/90.02; 211/119.003; 211/103; 211/207

(58) Field of Classification Search
USPC ..... 211/103, 190, 287, 207, 193, 59.2, 150, 211/90.01, 90.02, 4, 87, 41, 7, 192; 248/298.1, 235, 241, 250, 220.41, 248/220.43, 225.21; 108/102, 108; 312/216; 70/57.1, 58–62; 292/137, 292/163, 174, 175, DIG. 63
See application file for complete search history.

(56) References Cited

U.S. PATENT DOCUMENTS

| | | | | |
|---|---|---|---|---|
| 1,856,239 | A | 5/1932 | Buckley | |
| 3,785,501 | A * | 1/1974 | Canning | 211/7 |
| 3,827,569 | A * | 8/1974 | Canning | 211/7 |
| 3,908,949 | A | 9/1975 | Larson | |
| 4,155,458 | A * | 5/1979 | Moline | 211/4 |
| 4,289,242 | A | 9/1981 | Kenyon | |
| 4,406,374 | A | 9/1983 | Yedor | |
| 4,462,497 | A | 7/1984 | Maule | |
| 4,882,868 | A | 11/1989 | Fast | |

(Continued)

OTHER PUBLICATIONS

"First Line™ Security Solutions," Southern Imperial, Inc., www.southernimperial.com, dated at least as early as Sep. 26, 2011, 2 pages.

(Continued)

*Primary Examiner* — Jonathan Liu
*Assistant Examiner* — James Twomey
(74) *Attorney, Agent, or Firm* — Marshall, Gerstein & Borun LLP; Michael P. Furmanek

(57) ABSTRACT

A merchandise display device includes a rear cross-bar, first and second side arms, a locking pin, and a front cross-bar that is interoperable with the locking pin to secure merchandise on the display device and to secure the display device to a vertical support member. The locking pin is carried by a side arm and movable between an extended position and a retracted position. When occupying the extended position, the locking pin is adapted to engage the vertical support member to secure the merchandise display device thereto. The front cross-bar is mounted to the first and second side arms and is movable between a locked position, engaging the locking pin to prevent the locking pin from being moved out of the extended position, and an unlocked position, spaced away from the locking pin to allow movement of the locking pin out of the extended position toward the retracted position.

27 Claims, 5 Drawing Sheets

(56) References Cited

U.S. PATENT DOCUMENTS

| | | | | |
|---|---|---|---|---|
| 5,027,622 | A | 7/1991 | Hatch et al. | |
| 5,259,220 | A | 11/1993 | Fredrickson | |
| 5,275,027 | A | 1/1994 | Eklof et al. | |
| 5,348,167 | A | 9/1994 | Jensen | |
| 5,390,761 | A * | 2/1995 | Perry | 182/118 |
| 5,407,170 | A | 4/1995 | Slivon et al. | |
| 5,520,291 | A * | 5/1996 | Graham | 211/4 |
| 5,533,079 | A | 7/1996 | Colburn et al. | |
| 5,676,258 | A | 10/1997 | Leyden et al. | |
| 5,823,358 | A | 10/1998 | Leyden et al. | |
| 6,003,685 | A | 12/1999 | Malin | |
| 6,474,478 | B1 | 11/2002 | Huehner et al. | |
| 6,491,169 | B1 | 12/2002 | Salonen | |
| 6,622,979 | B2 | 9/2003 | Valiulis | |
| 6,659,291 | B2 | 12/2003 | Huehner et al. | |
| 6,799,523 | B1 * | 10/2004 | Cunha | 108/108 |
| 6,957,555 | B1 * | 10/2005 | Nagel et al. | 70/57.1 |
| 7,007,810 | B2 | 3/2006 | Huehner et al. | |
| 7,104,094 | B2 * | 9/2006 | Zadak et al. | 70/58 |
| 7,131,512 | B2 | 11/2006 | Aoki | |
| 7,131,542 | B2 * | 11/2006 | Sedon et al. | 211/59.1 |
| 7,137,513 | B2 * | 11/2006 | Sedon et al. | 211/59.1 |
| 7,197,902 | B1 | 4/2007 | Barkdoll | |
| 7,269,983 | B1 | 9/2007 | Mchatet | |
| 7,703,308 | B2 | 4/2010 | Nagelski | |
| 2002/0179546 | A1 | 12/2002 | McMurray et al. | |
| 2004/0155000 | A1 | 8/2004 | Mele et al. | |
| 2010/0223965 | A1 | 9/2010 | Richardson et al. | |
| 2010/0300992 | A1 | 12/2010 | Surma et al. | |

OTHER PUBLICATIONS

"36 Inch First Line Security Lock Bar," Southern Imperial, Inc., www.southernimperial.com, retrieved from internet on Dec. 6, 2011, 2 pages.

* cited by examiner

MERCHANDISING DISPLAY DEVICE

FIELD OF THE DISCLOSURE

The present disclosure relates to a merchandising display device and, more particularly, to a merchandising display device that provides for the secure display of merchandise on merchandising hooks.

BACKGROUND

Merchandise display devices are typically configured to display the merchandise and to enable a customer to see the merchandise and select items prior to purchasing. However, shoplifting is a known problem in retail settings, especially for high priced items.

SUMMARY

One aspect of the present disclosure includes a merchandise display device for being mounted to a vertical support member. The device includes a rear cross-bar, first and second side arms, at least one locking pin, and a front cross-bar. The rear cross-bar has opposing first and second ends. The first and second side arms extend outward from the opposing first and second ends of the rear cross-bar, respectively. Each side arm includes a proximal end fixed to the rear cross-bar and a distal end spaced from the rear cross-bar. The at least one locking pin is carried by one of the first and second side arms and includes a locking end disposed adjacent to the proximal end of the corresponding side arm and an abutment end disposed adjacent to the distal end of the corresponding side arm. The locking pin is movable between an extended position, wherein the locking pin extends beyond an end surface of the proximal end of the corresponding side arm, and a retracted position, wherein the locking pin is retracted relative to the extended position. As such, when occupying the extended position, the locking end of the locking pin is adapted to engage the vertical support member to secure the merchandise display device thereto. The front cross-bar is mounted to and extends between the distal ends of the first and second side arms. Additionally, the front cross-bar is movable between a locked position, wherein the front cross-bar engages the abutment end of the locking pin to prevent the locking pin from being moved out of the extended position, and an unlocked position, wherein the front cross-bar is spaced away from the abutment end of the locking pin to allow movement of the locking pin out of the extended position toward the retracted position.

DETAILED DESCRIPTION

Figure 1:
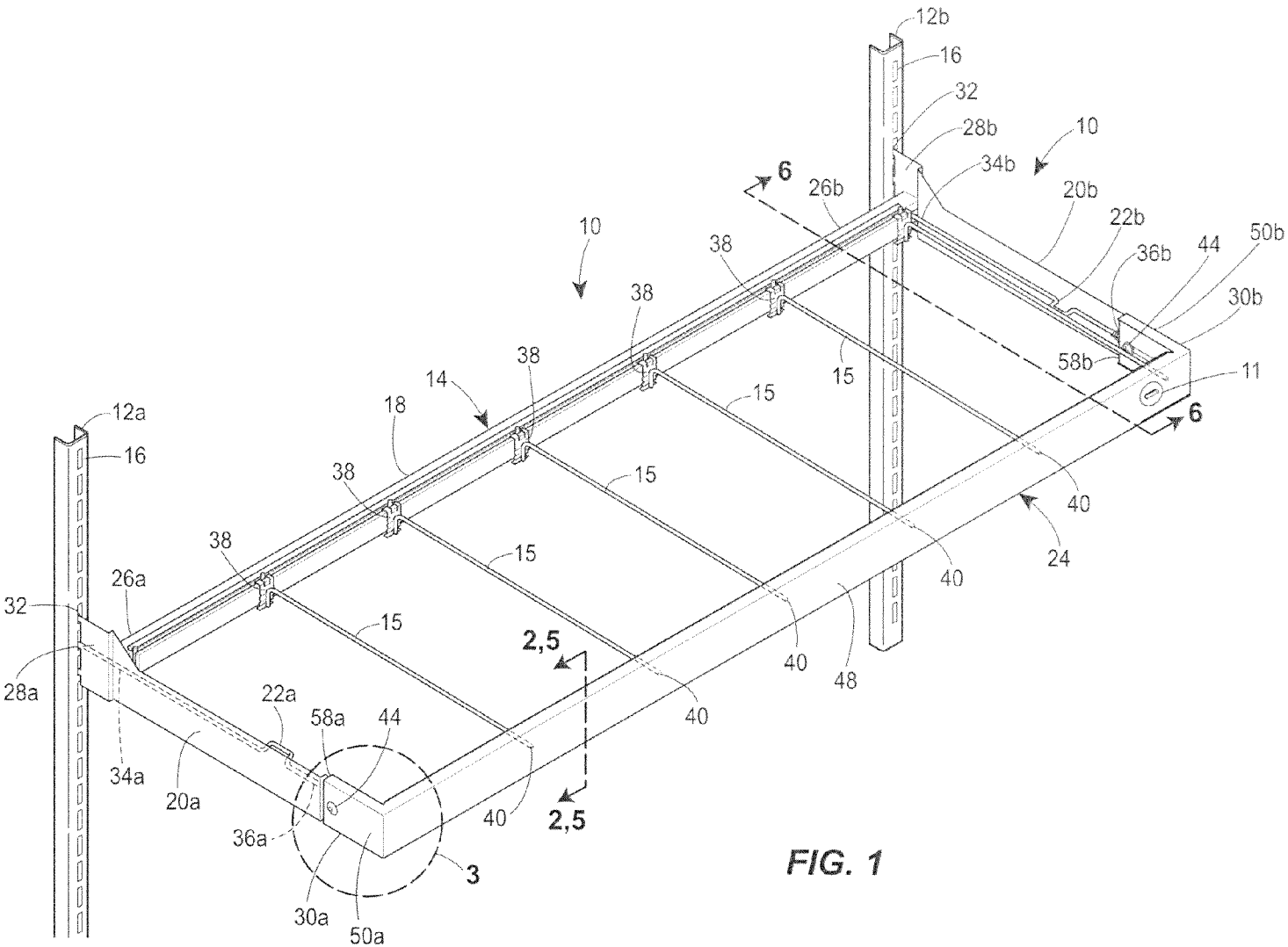
FIG. 1 is a perspective view of a merchandise display system constructed in accordance with the present disclosure.

FIG. 1 depicts one version of a merchandise display system 10 constructed in accordance with the principles of the present disclosure. The system 10 includes at least one vertical support member 12, a lock bar device 14, and at least one peg hook 15, from merchandise (not shown) can be hung. In this version, the at least one vertical support member 12 includes a pair of parallel vertical support members 12*a*, 12*b*, each mounted to a vertical surface such as a wall, for example, and including a plurality of first and second mounting apertures 16 spaced apart vertically in a conventional manner. As depicted, the mounting apertures 16 are rectangular in shape.

The lock bar device 14 is removably connected to the vertical support members 12*a*, 12*b* and includes a rear cross-bar 18, first and second side arms 20*a*, 20*b*, at least one locking pin 22, and a front cross-bar 24. In this version, the lock bar device 14 includes first and second locking pins 22*a*, 22*b*, each carried by and corresponding to one of the respective first and second side arms 20*a*, 22*b*, as depicted.

The rear cross-bar 18 can be a generally straight tubular or solid member, with opposing first and second ends 26*a*, 26*b*, outward from which the first and second side arms 20*a*, 20*b* extend. Each side arm 20*a*, 20*b* of this example includes a generally flat plate like member with a corresponding proximal end 28*a*, 28*b* fixed to the rear cross-bar 18 and a distal end 30*a*, 30*b* spaced outwardly from the rear cross-bar 18. In other examples, the side arms 20*a*, 20*b* can be constructed of bars, rods, cages, blow-molded structures, or any other structure suitable for the intended purpose. The proximal end 28*a*, 28*b* of each side arm 20*a*, 20*b* includes an enlarged rectangular plate portion with at least one support hook 32 (also shown in FIGS. 6-8) extending rearward therefrom and disposed in corresponding mounting apertures 16 of the vertical support members 12*a*, 12*b*. Thus, the support hooks 32 removably connect the lock bar device 14 to the vertical support members 12*a*, 12*b*. In the present version, the proximal ends 28*a*, 28*b* of the side arms 20*a*, 20*b* include a plurality of support hooks 32 and, more particularly, three supports hooks 32 removably disposed in a corresponding three mounting apertures 16.

Figure 3:
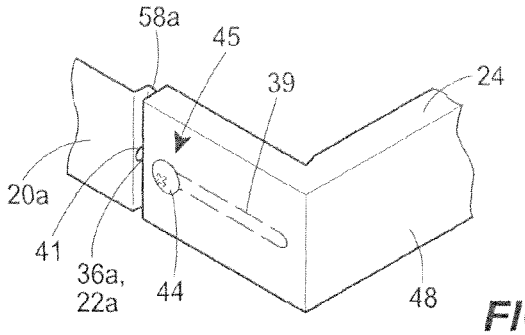
FIG. 3 is a partial detail view of the merchandise display system of FIG. 1 taken from circle 3 of FIG. 1, with the front cross-bar in the locked position.
Figure 4:
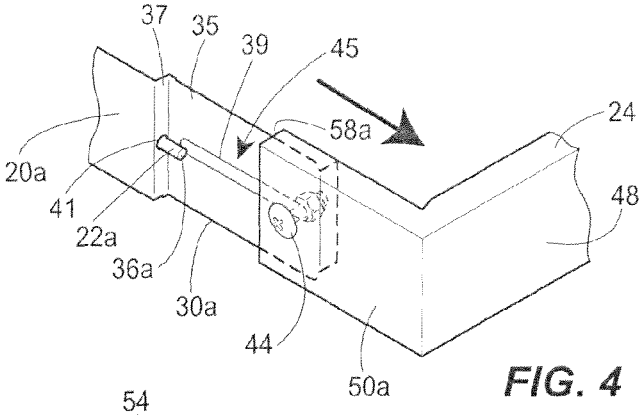
FIG. 4 is a partial detail view similar to FIG. 3, but showing the front cross-bar in an unlocked position.

With reference to FIGS. 3 and 4, where only one side arm 20*a* of the two side arms 20*a*, 20*b* is departed, it is shown that the distal end 30*a*, 30*b* of each side arm 20*a*, 20*b* includes an offset plate portion 35 connected to the remainder of the side arm 20*a*, 20*b* via a lateral plate portion 37 that extends transversely between the offset plate portion 35 and the remainder of the side arm 20*a*, 20*b*. The lateral plate portion 37 defines an aperture 41 receiving the corresponding locking pin 22*a*, 22*b*, and the offset plate portion 35 defines a linear (i.e., straight) elongated slot 39.

Each slot 39 receives a fastener 44 carried by and fixed to the front cross-bar 24 and slidably securing the front cross-bar 24 to the side arms 20*a*, 20*b*. For the sake of description, the linear slot 39 and fastener 44 can be considered a slide mechanism 45 for enabling movement of the front cross-bar 24 such that the version depicted in FIG. 1 includes first and second slide mechanisms 45, each including the linear slot 39 and corresponding fastener 44. The fastener 44 can include a generally conventional nut and bolt configuration, as illustrated, but could alternatively include a rivet, a pin, or generally any other type of device capable of serving the intended purpose. While the slots 39 of the slide mechanisms 45 are described in this example as being defined by the side arms 20*a*, 20*b* and the fasteners 44 are carried by and fixed to the front cross-bar 24, the slots 39 could be defined by the front cross-bar 24 and the fasteners 44 could be carried by and fixed to the side arms 20*a*, 20*b*.

Figure 6:
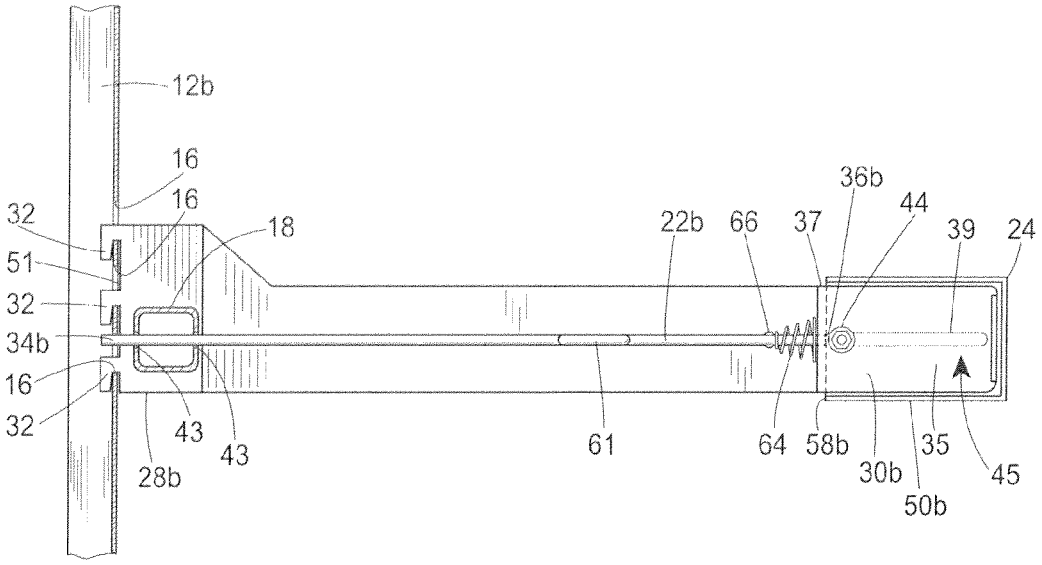
FIG. 6 is a cross-sectional view the merchandise display device of FIG. 1, taken from the perspective of line 6-6 of FIG. 1, with the front cross-bar in the locked position and showing a locking pin in an extended position
Figure 7:
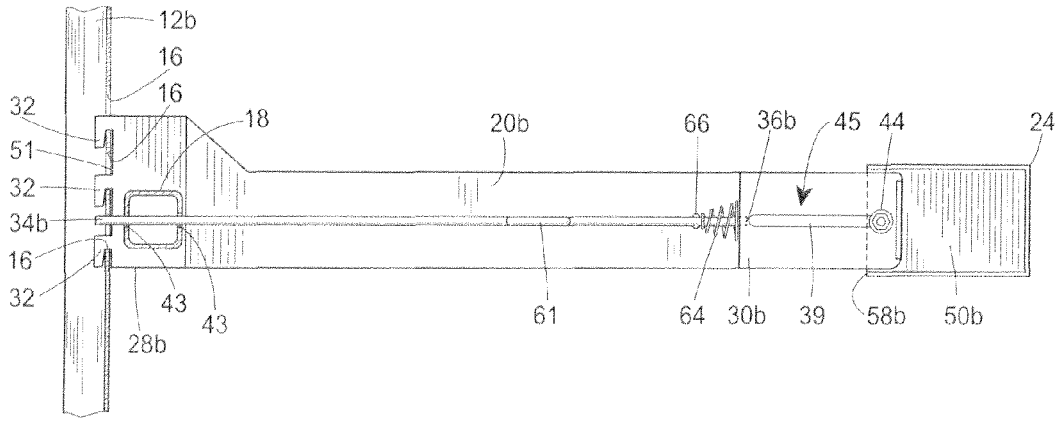
FIG. 7 is a cross-sectional view similar to that of FIG. 6, but with the front cross-bar in the unlocked position.
Figure 8:
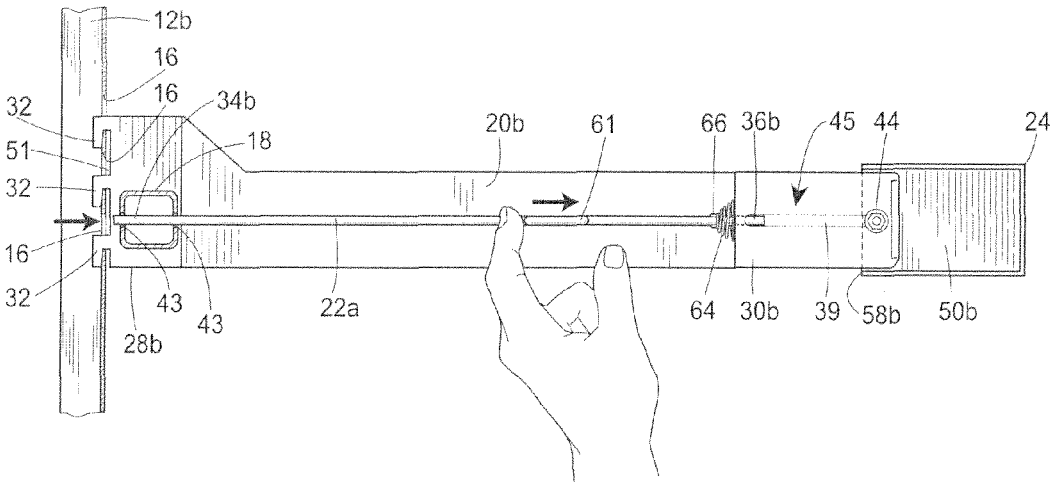
FIG. 8 is a cross-sectional view similar to that of FIG. 7, but showing an operator moving locking pin out of the extended position and into a retracted position.

As mentioned, the lock bar device 14 of FIG. 1 includes two locking pins 22*a*, 22*b*. Each locking pin 22*a*, 22*b* includes a locking end 34*a*, 34*b* disposed adjacent to the proximal end 28*a*, 28*b* of the corresponding side arm 20*a*, 20*b* and an abutment end 36*a*, 36*b* disposed adjacent to the distal end 30*a*, 30*b* of the corresponding side arm 20*a*, 20*b*. The abutment ends 36*a*, 36*b* of the locking pins 22*a*, 22*b* are slidably accommodated within the apertures 41 (FIGS. 3 and 4) of the lateral plate portions 37 of the side arms 20*a*, 20*b*. The locking ends 34*a*, 34*b* of the locking pins 22*a*, 22*b* are accommodated in apertures 43 formed through the rear cross-bar 18, as depicted in FIGS. 6-8, for example. As depicted, the locking pins 22*a*, 22*b* can be formed of generally cylindrical rods shaped to the desired form, or the locking pins 22*a*, 22*b* can be constructed differently including, for example, flat plates, square rods, etc. Moreover, while the locking pins 22*a*, 22*b* are illustrated as being constructed of a single piece of material, they alternatively could be formed as a linkage assembly, for example, or some other assembly of multiple interconnected or interacting components to achieve the desired result. As such, a locking pin is not limited to the specific construct described and depicted herein.

As will be described more fully below, the locking pins 22*a*, 22*b* are movable between an extended position (see, e.g., FIGS. 6 and 7) and a retracted position (see, e.g., FIG. 8). In the extended positions (see, e.g., FIGS. 6 and 7), the locking ends 34*a*, 34*b* of the locking pins 22*a*, 22*b* extend beyond an end surface 51 of the proximal ends 28*a*, 28*b* of the side arms 20*a*, 20*b* and into one of the plurality of mounting apertures 16 of the vertical support members 12*a*, 12*b*. This disposition prevents removal of the lock bar 14 from the vertical support members 12*a*, 12*b*. In the retracted positions (see, e.g., FIG. 8), the locking pins 22*a*, 22*b* are retracted relative to the extended positions and disposed out of the mounting apertures 16. for This disposition allows the lifting and removal of the lock bar 14 from the vertical support members 12*a*, 12*b*. In the present version, when in the retracted position, the locking ends 34*a* 34*b* of the locking pins 22*a*, 22*b* are positioned inside of the end surfaces 51 of the proximal ends 28*a*, 28*b* of the side arms 20*a*, 20*b*, as depicted in FIG. 8, at a location between the end surfaces 51 and the rear cross-bar 18.

Figure 2:
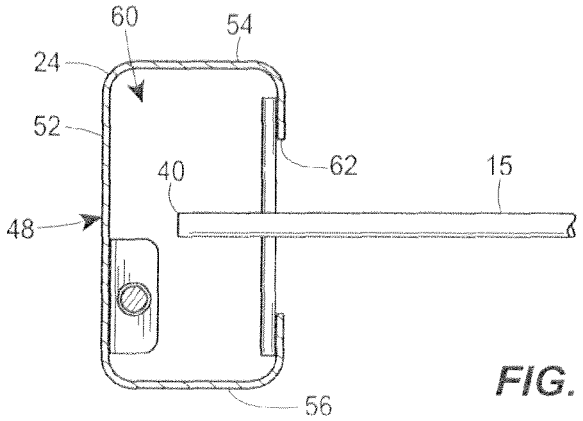
FIG. 2 is a cross-sectional view of the merchandise display system of FIG. 1 taken from the perspective of line 2-2 of FIG. 1 with a front cross-bar thereof in a locked position.
Figure 5:
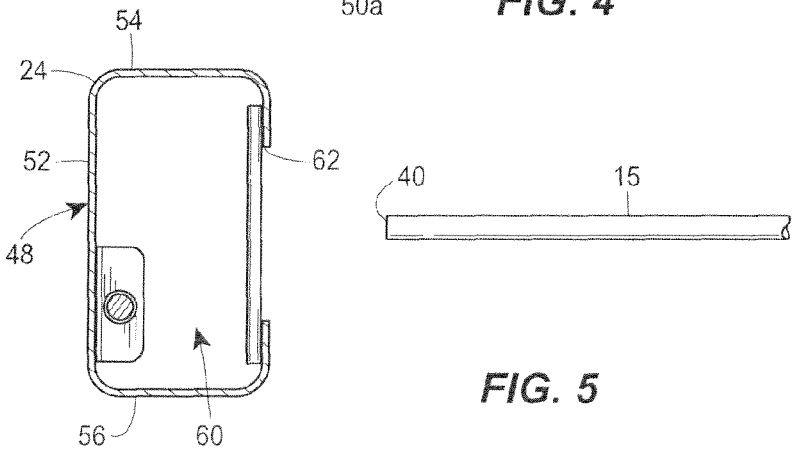
FIG. 5 is a cross-sectional view similar to FIG. 2, but showing the front cross-bar in the unlocked position.

Referring back to FIG. 1, the front cross-bar 24 is mounted to and extends between the distal ends 30*a*, 30*b* of the first and second side arms 20*a*, 20*b*. As shown, the front cross-bar 24 includes a central portion 48, opposing side portions 50*a*, 50*b*, and a key lock 11. The side portions 50*a*, 50*b* extend away from the central portion 48 toward the side arms 20*a*, 20*b* and are attached to the distal ends 30*a*, 30*b* of the side arms 20*a*, 20*b* via the fasteners 44. The central portion 48 extends between the side portions 50*a*, 50*b*. As shown in FIGS. 2 and 5, for example, the central portion 48 includes a face plate 52, a top plate 54, and a bottom plate 56. The top and bottom plates 54, 56 extend rearward away from the face plate 52. So configured, the central portion 48 of the front cross-bar 24 of the present version of the merchandise display system 10 includes a generally C-shaped cross-section defining an elongated channel (aka, cavity) 60 inside of the central portion 48 and at least one window 62 providing access to the channel 60.

Again, referring back to FIG. 1, at least one peg hook 15 of the present version of the merchandise display system 10 includes five straight peg hooks 15 extending outward from the rear cross-bar 18 between the first and second side arms 20*a*, 20*b*. Each peg hook 15 includes a mounted end 38 connected to the rear cross-bar 18 and a free end 40 spaced from the rear cross-bar 18.

Due to the attachment of the front cross-bar 24 to the side arms 20*a*, 20*b* via the fasteners 44 and the linear elongated slots 39, the front cross-bar 24 is also movable (i.e., linearly slidable) between a locked position (see, e.g., FIGS. 1, 2, 3, and 6) and an unlocked position (see, e.g., FIGS. 4, 5, 7, and 8). In the locked position, terminal ends 58*a*, 58*b* of the side portions 50*a*, 50*b* of the front cross-bar 24 engage the corresponding abutment ends 36*a*, 36*b* of the locking pins 22*a*, 22*b*, as clearly shown in FIG. 3. This engagement prevents the locking pins 22*a*, 22*b* from being moved out of the extended positions, as depicted in FIG. 6, for example. Additionally, as shown in FIG. 2, when in the locked position, the front cross-bar 24 is disposed adjacent to the free ends 40 of the peg hooks 15 to prevent the removal of merchandise off the peg hooks 15. More specifically, as depicted in FIG. 2, the peg hooks 15 extend through the at least one window 62 in the front cross-bar 24 such that the free ends 40 reside inside of the elongated channel 60. So configured, merchandise hanging from the peg hooks 15 cannot be slid off of the free ends 40, because any merchandise being slid toward the free ends 40 would be stopped by either or both of the rearwardly projecting top and bottom plates 54, 56.

In the unlocked position, the front cross-bar 24 is moved linearly outward and spaced away from the abutment ends 36*a*, 36*b* of the locking pins 22*a*, 22*b*, as shown in FIG. 4, to allow movement of the locking pins 22*a*, 22*b* out of the extended positions the retracted positions. Additionally, as shown in FIG. 5, when in the unlocked position, the front cross-bar 24 is spaced away from the free ends 40 of the peg hooks 15 such that the free ends 40 no longer reside within the elongated channel 60. Instead, the free ends 40 are spaced rearward of the window 62. So configured, any merchandise hanging on the peg hooks 15 can be removed from (i.e., slid off of) the free ends 40 of the peg hooks 15 and lowered for retrieved by a customer, for example, without interference by the top and bottom plates 54, 56.

As mentioned, the position of the front cross-bar 24 can prevent or allow the locking pins 22*a*, 22*b* to be moved between the extended and retracted positions. Additionally, in the presently disclosed version, each of the locking pins 22*a*, 22*b* can be equipped with a biasing element 64, as depicted in FIGS. 6 and 7 for example, that biases the locking pins 22*a*, 22*b* into the extended positions. As shown, the biasing elements 64 can include coil springs through which the locking pins 22*a*, 22*b* extend. In the disclosed version, each locking pin 22*a*, 22*b* includes a lateral protrusion 66 and the biasing element 64 is disposed on the corresponding locking pin 22*a*,

22*b* at a location between the lateral protrusion 66 such as a nub and the adjacent lateral plate portion 37 of the corresponding side arm 20*a*, 20*b*. As such, the biasing element 64 applies a force to urge the lateral protrusions 66, and therefore the locking pins 22*a*, 22*b*, away from the lateral plate portions 37 of the side arms 20*a*, 20*b*, which in turn, urges the locking pins 22*a*, 22*b* into the extended positions shown in FIGS. 6 and 7, whereby the locking ends 34*a*, 34*b* engage apertures 16 in the vertical support members 12*a*, 12*b*.

Because of the foregoing construct, the merchandise display system 10 thus far described advantageously includes an interoperability between the sliding front cross-bar 24 and the locking pins 22*a*, 22*b* that securely locks merchandise onto the peg hooks 15, as well as locks the lock bar device 14 to the vertical support members 12*a*, 12*b*. When the front cross-bar 24 of the lock bar device 14 is in the locked position, a user can neither remove merchandise from the peg hooks 15 nor remove the lock bar device 14 from the vertical support members 12*a*, 12*b*. Specifically, as described above with reference to FIGS. 1-3, with the front cross-bar 24 in the locked position, the free ends 40 of the peg hooks 15 are positioned in the channel 60 such that merchandise cannot be removed. Additionally, when the front cross-bar 24 is in the locked position, the terminal ends 58*a*, 58*b* of the side portions 50*a*, 50*b* engage the abutment ends 36*a*, 36*b* of the locking pins 22*a*, 22*b* to maintain the locking pins 22*a*, 22*b* in the extended positions, whereby the locking ends 34*a*, 34*b* are disposed in the mounting apertures 16 of the vertical support members 12*a*, 12*b*, as depicted in FIGS. 6 and 7. So disposed, the locking end 34*a*, 34*b* of each locking pin 22*a*, 22*b* physically engages an inner top surface of the corresponding mounting aperture 16, thereby acting as a stop and preventing a user from lifting the side arms 20*a*, 20*b* to remove the support hooks 32 from the mounting apertures 16. This interoperable dual-locking feature of the present disclosure is highly advantageous as it simplifies attachment and detachment of the lock bar device 14 from the vertical support members 12*a*, 12*b*, while also providing two levels of security.

In order to remove merchandise from the peg hooks 15 and/or remove the lock bar device 14 from the vertical support members 12*a*, 12*b*, a user must unlock the key lock 11 and slide the front cross-bar 24 linearly outward from the locked position to the unlocked position. Although not depicted in detail, the key lock 11 can include a conventional barrel-type lock mechanism that includes a plate that rotates into and out of contact with a corresponding plate carried by the second side arm 20*b*, for example, for restricting movement of the front cross-bar 24. These types of locks are also possible. With the cross-bar 24 in the unlocked position, merchandise can be removed from the peg hooks 15. If the user wishes to further remove the entire lock bar device 14 from the vertical support members 12*a*, 12*b*, the user can manually urge handle portions 61 of the locking pins 22*a*, 22*b* out of the extended positions and into the retracted positions, as depicted in FIG. 8, for example. With the locking pins 22*a*, 22*b* on each side of the lock bar device 14 occupying the retracted positions, the user is then free to lift the entire lock bar device 14 off of the vertical support members 12*a*, 12*b* because the support hooks 32 can be freely displaced upward and slid out of the mounting apertures 16.

While the front cross-bar 24 of the above example has been depicted and described as being constructed of the face plate 52, the top plate 54, and the bottom plate 56, thereby defining the C-shaped cross-section with the elongated channel 60 and the window 62, one alternative can be constructed more like a cage. That is, the front cross-bar 24 can be constructed of two or more horizontally extending rods connected by two or more vertically extending rods. So configured, the various rods define a cage-like front cross-bar with one or more windows or openings formed therein. To facilitate the desired objective of locking merchandise on the peg hooks 15, the distal ends 40 of the peg hooks 15 used with the cage-like front cross-bar 24 can extend through the windows or openings of the cage. As such, the distal ends 40 of the peg hooks of this example can be said to be trapped by the front cross-bar 24 of this example when the front cross-bar 24 is in the locked position to thereby secure merchandise on the peg hooks 15. To add yet another layer of security, the distal ends 40 of the peg hooks 15 used with the cage-like front cross-bar 24 could further include an upward turned portion. Where peg hooks 15 with upward turned portions are used, it could also be advantageous to utilize a sliding or pivoting front cross-bar, as disclosed, for example, with respect to FIGS. 9-12 below.

Therefore, while the lock bar device 14 of FIGS. 1-8 has been depicted and described as including a front cross-bar 24 attached to the side arms 20*a*, 20*b* via slide mechanisms 45 including linear (i.e., straight) slots 39, thereby enabling linear movement of the front cross-bar 24 between the locked and unlocked positions, this is merely one example and different constructs can be implemented to move the front cross-bar 24 between locked and unlocked positions.

Figure 9:
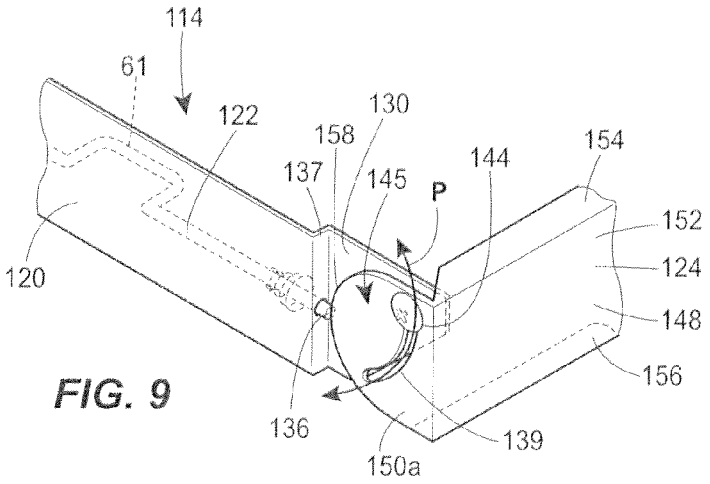
FIG. 9 is a partial perspective view of an alternative merchandising display device showing a front cross-bar in a locked position.
Figure 10:
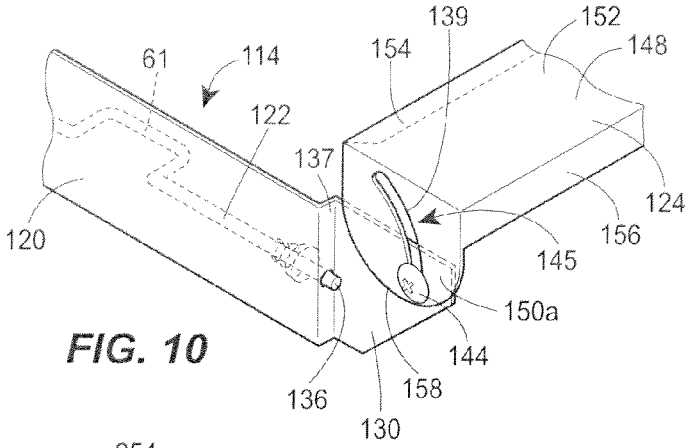
FIG. 10 is a partial perspective view similar to FIG. 9, but with the front cross-bar in an unlocked position.

FIGS. 9 and 10 depict another construct of a lock bar device 114 including a front cross-bar 124 that is movable between a locked position (FIG. 9) and an unlocked position (FIG. 10) via slide mechanisms 145 that include fasteners 144 disposed within arcuate slots 139. While FIGS. 9 and 10 only depict a small portion of the lock bar device 114, the remainder of the device 114 can be similar to that described previously, with the exception that the opposite side of the front cross-bar 124 also includes a slide mechanism 145 with an arcuate slot 139 and corresponding features. Only those features shown in FIGS. 9 and 10 will be described.

As shown, the front cross-bar 124 of the example depicted in FIGS. 9 and 10 slides between the locked position (FIG. 9) and unlocked position (FIG. 10) along a path P (e.g., an arcuate path) defined by the arcuate slot 139. As further illustrated in FIGS. 9 and 10, the lock bar device 114 includes a side arm 120 carrying a locking pin 122, in a manner generally identical to that described above with respect to FIGS. 1-8. The locking pin 122 includes an abutment end 136 extending through a transverse plate portion 137 and adjacent to a distal end 130 of the side arm 120. The front cross-bar 124, similar to the front cross-bar 24 described above, includes a central portion 148 having a C-shaped cross-section defined by a face plate 152, a top plate 154, and a bottom plate 156. Additionally, the front cross-bar 124 includes opposing side arm portions 150, only one of which is illustrated in FIGS. 9 and 10. The opposing side arm portions 150 define the arcuate slots 139 of the slide mechanisms 145 and also include terminal ends 158 disposed away from the face plate 152.

So configured, when the front cross-bar 124 of the example depicted in FIGS. 9 and 10 is in the locked position, as shown in FIG. 9, the front cross-bar 124 receives the free ends 40 of any peg hooks 15 carried by the lock bar device 114 in a manner generally identical to that described above with reference to FIGS. 2 and 5. Additionally, in the locked position, the terminal ends 158 of the side portions 150 of the front-cross bar 124 engage the abutment ends 136 of the locking pins 122, thereby retaining the locking pins 122 in the extended positions, as discussed above with respect to FIGS. 6-10, for example. Thus, in order to remove merchandise form the peg hooks 15 and/or remove the lock bar device 114 from corresponding vertical support members 12*a*, 12*b*, as shown in FIG. 1, for example, a user must first unlock a key lock (not shown in FIGS. 9 and 10 but similar to those described above) and slide the front cross-bar 124 into the unlocked position depicted in FIG. 10. In this position, the user can then freely manually manipulate the locking pins 122 and displace them into the retracted position, similar to that which was described above with reference to FIG. 8.

While the slots 139 of the slide mechanisms 145 are described in this example as being defined by the side portions 150 of the front cross-bar 124 and the fasteners 144 are held by the distal ends 130 of the side arms 120, in an alternative construct, the slots 139 could be defined by the side arms 120 and the fasteners 144 could be carried by the front cross-bar 124.

Figure 11:
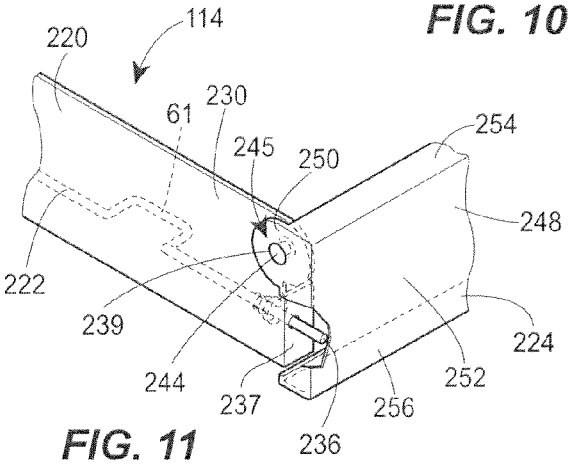
FIG. 11 is a partial perspective view of another alternative merchandising display device showing a front cross-bar in a locked position.
Figure 12:
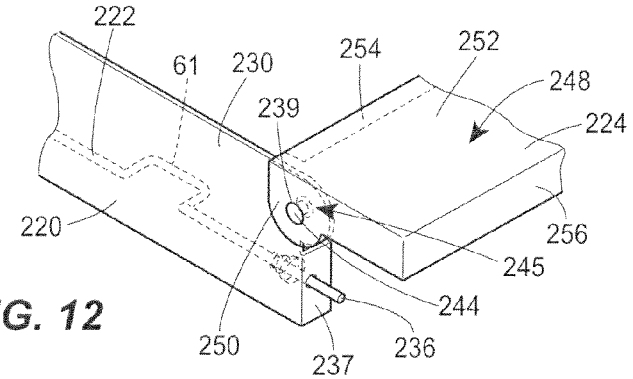
FIG. 12 is a partial perspective view similar to FIG. 11, but with the front cross-bar in an unlocked position.

While the lock bar devices 14, 114 thus far described include slide mechanisms 45, 145 for enabling guided movement of the front cross-bars 24, 124 and selective locking engagement of the locking pins 22, 122, FIGS. 13 and 14 depict another alternative example of a lock bar device 214 that includes hinges 245 for accomplishing this objective. Only one portion of the device 214 is depicted in FIGS. 11 and 12, but the other side would be constructed identically. Similar to the above-described examples, the lock bar device 214 includes side arms 220 carrying locking pins 222. Only one side arm 220, and locking pin 222 are shown and will be described. The locking pin 222 includes an abutment end 236 extending through a lateral plate portion 237 and adjacent to a distal end 230 of the side arm 220. The front cross-bar 224, similar to the front cross-bars 24, 124 described above, includes a central portion 248 having a C-shaped cross-section defined by a face plate 252, a top plate 254, and a bottom plate 256. Additionally, the front cross-bar 224 includes opposing side arm portions 250. The opposing side arm portions 250 define an aperture 239 receiving a fastener 244, the combination of which form the hinges 245. Although described this way, the side arm portion 250 of the front cross-bar 224 can carry the fasteners 244 and the distal ends 230 of the side arms 220 can define the apertures 239.

So configured, and as shown in FIG. 11, when the front cross-bar 224 of this example is in the locked position, the front cross-bar 224 receives the free ends 40 of any peg hooks 15 carried by the lock bar device 214 in a manner generally identical to that described above with reference to FIGS. 2 and 5. Additionally, an inside surface of the face plate 252 of the front-cross bar 224 engages the abutment ends 236 of the locking pins 222, thereby keeping the locking pins 222 in the extended positions, as discussed above with respect to FIGS. 6-8, for example. Thus, in order to remove merchandise from the peg hooks 15 and/or remove the lock bar device 214 from corresponding vertical support members 12*a*, 12*b*, as shown in FIG. 1, for example, a user must first unlock the key lock (not shown in FIGS. 11 and 12) and pivot the front cross-bar 224 about the fasteners 244 and into the unlocked position depicted in FIG. 12. In this position, the user can then freely manually manipulate the locking pins 222 and displace them into the retracted position, similar to that which was described above with reference to FIG. 8.

While the abutment ends 236 of the example lock bar device 214 in FIGS. 11 and 12 have been described as being engaged by the inner surface of the face plate 252 when the front cross-bar 224 is in the locked position, the device 214 could be designed such that the abutment ends 236 could alternatively be engaged by terminal ends of the side portions 250 of the front cross-bar 224, for example, or some other aspect of the front cross-bar 224.

While the foregoing disclosure provides various examples of devices and systems of the present invention, the disclosure is not limited to the specific examples disclosed. Rather, any one or more features of any one or more of the examples can be commingled, interchanged, or otherwise combined to arrive at still yet other examples not expressly disclosed. The disclosure of one feature in one example does not preclude the incorporation of that feature in other examples, but rather, it expressly provides that such a feature can be implemented into any other example.

I claim:

1. A merchandise display device for being mounted to a vertical support member, the device comprising:

a rear cross-bar having opposing first and second ends;

first and second side arms extending outward from the opposing first and second ends of the rear cross-bar, respectively, each side arm including a proximal end fixed to the rear cross-bar and a distal end spaced from the rear cross-bar;

at least one locking pin carried by one of the first and second side arms and including a locking end disposed adjacent to the proximal end of the corresponding side arm and an abutment end disposed adjacent to the distal end of the corresponding side arm, the locking pin movable between an extended position, wherein the locking pin extends beyond an end surface of the proximal end of the corresponding side arm, and a retracted position, wherein the locking pin is retracted relative to the extended position, such that when occupying the extended position, the locking end of the locking pin is adapted to engage the vertical support member to secure the merchandise display device thereto; and a front cross-bar mounted to and extending between the distal ends of the first and second side arms, the front cross-bar movable between a locked position, wherein a portion of the front cross-bar engages the abutment end of the locking pin to prevent the locking pin from being moved out of the extended position, and an unlocked position, wherein the portion of the front cross-bar is spaced away from the abutment end of the locking pin to allow movement of the locking pin out of the extended position toward the retracted position;

at least one peg hook extending outward from the rear cross-bar between the first and second side arms, the peg hook including a mounted end connected to the rear cross-bar and a free end spaced from the rear cross bar, the front cross-bar is disposed adjacent to the free end of the at least one peg hook when in the locked position to prevent the removal of merchandise from the peg hook, and the front cross-bar is spaced away from the free end of the at least one peg hook when in the unlocked position to enable the removal of merchandise from the peg hook.

2. The device of claim 1, further comprising a biasing element disposed on the locking pin and biasing the locking pin into the extended position.

3. The device of claim 1, wherein the at least one locking pin comprises a first locking pin carried by the first side arm and a second locking pin carried by the second side arm.

4. The device of claim 1, further comprising first and second slide mechanisms connecting the first and second side arms to the front cross-bar, respectively, the first and second slide mechanisms enabling the front cross-bar to slide between the locked and unlocked positions.

5. The device of claim 4, wherein each of the first and second slide mechanisms includes a fastener and a slot slidably receiving the fastener, such that the front cross-bar can slide between the locked and unlocked position.

6. The device of claim 5, wherein the fastener of the first slide mechanism is carried by the first side arm, the fastener of the second slide mechanism is carried by the second side arm, and the slots of the first and second slide mechanisms are carried by the front cross-bar.

7. The device of claim 5, wherein the slot comprises a straight slot.

8. The device of claim 5, wherein the slot comprises an arcuate slot.

9. The device of claim 1, further comprising first and second hinges connecting the first and second side arms, respectively, with the front cross-bar, the first and second hinges for enabling the front cross-bar to pivot between the locked and unlocked position.

10. A merchandise display system, comprising:

at least one vertical support member including a plurality of spaced apart mounting apertures; and a lock bar device removably connected to the at least one vertical support member, the lock bar device comprising:

a rear cross-bar having opposing first and second ends;

first and second side arms extending outward from the opposing first and second ends of the rear cross-bar, respectively, each side arm including a proximal end fixed to the rear cross-bar and a distal end spaced from the rear cross-bar, each side arm further comprising at least one support hook extending from the proximal ends thereof and disposed in a corresponding at least one of the mounting apertures formed in the vertical support member for removably connecting the lock bar to the vertical support member;

at least one locking pin carried by one of the first and second side arms and including a locking end disposed adjacent to the proximal end of the corresponding side arm and an abutment end disposed adjacent to the distal end of the corresponding side arm, the locking pin movable between an extended position, wherein the locking pin extends beyond an end surface of the proximal end of the corresponding side arm and into one of the plurality of mounting apertures of the vertical support member for preventing removal of the lock bar from the vertical support member, and a retracted position, wherein the locking pin is retracted relative to the extended position and from the mounting aperture for allowing the removal of the lock bar from the vertical support member; and a front cross-bar mounted to and extending between the distal ends of the first and second side arms, the front cross-bar movable between a locked position, wherein a portion of the front cross-bar engages the abutment end of the locking pin to prevent the locking from being moved out of the extended position, and an unlocked position, wherein the portion of the front cross-bar is spaced away from the abutment end of the locking pin to allow movement of the locking pin out of the extended position toward the retracted position;

the front cross-bar is disposed adjacent to the free end of the at least one peg hook when in the locked position to prevent the removal of merchandise from the peg hook, and The front cross-bar is spaced away from the free end of the at least one peg hook when in the unlocked position to enable the removal of merchandise from the peg hook.

11. The system of claim 10, further comprising at least one peg hook extending outward from the rear cross-bar between the first and second side arms, the peg hook including a mounted end connected to the rear cross-bar and a free end spaced from the rear cross-bar.

12. The system of claim 10, further comprising a biasing element disposed on the locking pin and biasing the locking pin into the extended position.

13. The system of claim 10, wherein the at least one locking pin comprises a first locking pin carried by the first side arm and a second locking pin carried by the second side arm.

14. The system of claim 10, further comprising first and second slide mechanisms connecting the first and second side arms to the front cross-bar, respectively, the first and second slide mechanisms enabling the front cross-bar to slide between the locked and unlocked positions.

15. The system of claim 14, wherein each of the first and second slide mechanisms includes a fastener and a slot slidably receiving the fastener, such that the front cross-bar can slide between the locked and unlocked position.

16. The system of claim 15, wherein the fastener of the first slide mechanism is carried by the first side arm, the fastener of the second slide mechanism is carried by the second side arm, and the slots of the first and second slide mechanisms are carried by the front cross-bar.

17. The system of claim 15, wherein the slot comprises a straight slot.

18. The system of claim 15, wherein the slot comprises an arcuate slot.

19. The system of claim 10, further comprising first and second hinges connecting the first and second side arms, respectively, with the front cross-bar, the first and second hinges for enabling the front cross-bar to pivot between the locked and unlocked position.

20. A device for being mounted to a vertical support member, the device comprising:

an arm including a proximal end for being attached to the vertical support member and a distal end spaced from the proximal end;

a locking pin carried by the arm and including a locking end disposed adjacent to the proximal end and an abutment end disposed adjacent to the distal end, the locking pin movable between an extended position, wherein the locking pin extends beyond an end surface of the proximal end of the arm, and a retracted position, wherein the locking pin is retracted relative to the extended position, such that when occupying the extended position, the locking end of the locking pin is adapted to engage the vertical support member to secure the device thereto; and a front bar mounted to the arm, the front bar movable between a locked position, wherein a portion of the front bar engages the abutment end of the locking pin to prevent the locking pin from being moved out of the extended position, and an unlocked position, wherein the portion of the front bar is spaced away from the abutment end of the locking pin to allow movement of the locking pin out of the extended position toward the retracted position;

a rear bar connected to the proximal end of the arm and at least one peg hook extending outward from the rear bar, the peg hook including a mounted end connecting to the rear bar and a free end spaced from the rear bar, The front bar is disposed adjacent to the free end of the at least one peg hook when in the locked position to prevent the removal of merchandise from the peg hook, and The front bar is spaced away from the free end of the at least one peg hook when in the unlocked position to enable the removal of merchandise from the peg hook.

21. The device of claim 20, further comprising a biasing element disposed on the locking pin and biasing the locking pin into the extended position.

22. The device of claim 20, further comprising a slide mechanism connecting the arm to the front bar, the slide mechanism enabling the front bar to slide between the locked and unlocked positions.

23. The device of claim 22, wherein the slide mechanism includes a fastener and a slot slidably receiving the fastener, such that the front bar can slide between the locked and unlocked position.

24. The device of claim 23, wherein the fastener of the slide mechanism is carried by the arm and the slot is carried by the front bar.

25. The device of claim 23, wherein the slot comprises a straight slot.

26. The device of claim 23, wherein the slot comprises an arcuate slot.

27. The device of claim 20, further comprising a hinge connecting the arm with the front bar, the hinge for enabling the front bar to pivot between the locked and unlocked position.

* * * * *